US009516958B1

(12) United States Patent
McAllister et al.

(10) Patent No.: US 9,516,958 B1
(45) **Date of Patent: *Dec. 13, 2016**

(54) ADJUSTABLE FOOD SHIELD

(71) Applicant: Metal Masters Foodservice Equipment Company, Inc., Clayton, DE (US)

(72) Inventors: Larry N. McAllister, Dover, DE (US); Kenneth Shawn Christianson, Clayton, DE (US); Brian Christopher Powell, Dover, DE (US)

(73) Assignee: Metal Masters Foodservice Equipment Company, Inc., Clayton, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/069,274

(22) Filed: Mar. 14, 2016

Related U.S. Application Data

(63) Continuation-in-part of application No. 14/677,232, filed on Apr. 2, 2015, now Pat. No. 9,326,621.

(51) Int. Cl.
*A47F 9/00* (2006.01)
*A47F 10/06* (2006.01)
*A47B 97/00* (2006.01)

(52) U.S. Cl.
CPC ..... *A47F 10/06* (2013.01); *A47B 97/00* (2013.01); *A47F 2010/065* (2013.01)

(58) Field of Classification Search
CPC ..... A47F 3/12; A47F 3/00; A47F 3/005; A47F 2003/008; A47F 2010/065; A47F 10/06; A47F 9/00; A47B 23/06; A47B 57/54; A47B 96/062; A47B 97/00; F16B 9/023; E06B 3/549
USPC ..... 312/137
See application file for complete search history.

(56) References Cited

U.S. PATENT DOCUMENTS

| | | | | |
|---|---|---|---|---|
| 384,784 | A | 6/1888 | Pihl | |
| 959,099 | A | 5/1910 | Anderson | |
| 1,231,635 | A | 7/1917 | Nelson | |
| 1,244,855 | A | 10/1917 | Hess | |
| 1,346,402 | A * | 7/1920 | Glaudel | B60J 1/14 296/96.11 |
| 1,353,552 | A | 9/1920 | Sweet | |
| 1,358,262 | A | 11/1920 | Sumner | |
| 1,385,485 | A * | 7/1921 | Comrie | B60J 1/14 296/96.11 |
| 1,779,236 | A | 10/1930 | Hoegger | |

(Continued)

*Primary Examiner* — Daniel J Troy
*Assistant Examiner* — Timothy M Ayres
(74) *Attorney, Agent, or Firm* — Panitch Schwarze Belisario & Nadel LLP

(57) ABSTRACT

A food shield has shield panels that are location adjustable and angularly adjustable in respect of support structures (posts) that are coupled to a mounting surface, such as a surface of a buffet table or cart. For vertical or location adjustment of a shield panel in relation to a post, a bracket assembly includes outer and inner collar portions, a grip element positioned between the outer and inner collar portions, and a tightening element that tightens the connection of the assembled collar against support posts. For angular adjustment, each bracket assembly includes an indexing base, a rotatable arm assembly with an indexing hub, and a removable or retractable coupling element. Alternative bracket assemblies provide support elements that contact one face of the shield panel, in addition to having clamps that engage the shield panel at or near each of the front and rear panel edges.

17 Claims, 14 Drawing Sheets

(56) References Cited

U.S. PATENT DOCUMENTS

| | | | | |
|---|---|---|---|---|
| 2,163,859 | A | 6/1939 | Ver Bockel | |
| 3,003,813 | A | 10/1961 | Bolenbach | |
| 3,026,162 | A | 3/1962 | Waszkiewicz | |
| 3,500,594 | A | 3/1970 | O'Brien | |
| 3,610,562 | A | 10/1971 | Holmes et al. | |
| 4,799,818 | A | 1/1989 | Sudimak et al. | |
| 5,199,680 | A | 4/1993 | Rivera | |
| 5,259,581 | A | 11/1993 | Goldberg | |
| 5,351,927 | A | 10/1994 | Howell | |
| 5,584,545 | A | 12/1996 | LaVaute et al. | |
| D377,429 | S | 1/1997 | Olson | |
| 5,964,439 | A * | 10/1999 | Johnson | A61G 5/10 248/278.1 |
| 6,132,018 | A | 10/2000 | McGrath | |
| 6,485,118 | B2 | 11/2002 | Matus, Jr. | |
| 6,588,863 | B1 | 7/2003 | Yatchak et al. | |
| 7,040,723 | B2 | 5/2006 | Matus, Jr. | |
| 7,155,869 | B2 | 1/2007 | Wildenhain et al. | |
| D543,740 | S | 6/2007 | Hartsfield, Jr. et al. | |
| D575,560 | S | 8/2008 | English | |
| D610,373 | S | 2/2010 | Matus, Jr. | |
| D610,374 | S | 2/2010 | Matus, Jr. | |
| D613,971 | S | 4/2010 | Matus, Jr. | |
| 7,895,953 | B2 | 3/2011 | Matus, Jr. | |
| 8,109,579 | B2 | 2/2012 | English et al. | |
| 8,308,249 | B2 | 11/2012 | Matus, Jr. | |
| 8,403,430 | B2 | 3/2013 | Atkins | |
| 8,585,160 | B2 | 11/2013 | Atkins | |
| 9,144,329 | B1 | 9/2015 | McGrath | |
| 9,326,621 | B1 | 5/2016 | McAllister et al. | |
| 9,339,131 | B1 | 5/2016 | Christianson | |
| 2001/0023562 | A1 | 9/2001 | Blobaum et al. | |
| 2003/0057810 | A1 | 3/2003 | DeWitt | |
| 2006/0163976 | A1 | 7/2006 | Matus | |
| 2006/0284522 | A1 | 12/2006 | Burke et al. | |
| 2007/0236112 | A1 | 10/2007 | Williman | |
| 2008/0092464 | A1 | 4/2008 | Haab et al. | |
| 2010/0045149 | A1 | 2/2010 | English et al. | |
| 2011/0080075 | A1 | 4/2011 | Matus, Jr. | |
| 2011/0169384 | A1 | 7/2011 | Padden et al. | |
| 2011/0193453 | A1 | 8/2011 | Matus, Jr. | |
| 2012/0200207 | A1 | 8/2012 | Atkins | |
| 2016/0073795 | A1 | 3/2016 | Matus, Jr. | |

* cited by examiner

ADJUSTABLE FOOD SHIELD

CROSS-REFERENCE TO RELATED APPLICATION

This application is a continuation-in-part of U.S. Ser. No. 14/677,232, filed Apr. 2, 2015, now issued as U.S. Pat. No. 9,326,621.

BACKGROUND

The present invention relates to food shields, and particularly adjustable food shields positioned over open receptacles and/or containers having food contained therein.

Food shields, also known as sneeze guards, are frequently positioned over open receptacles and/or containers, having food contained therein. Food shields are found in eateries that serve hot and cold food "buffet-style." Such eateries include, but are not limited to, cafeterias, buffet restaurants, restaurants with salad bars, and smorgasbords.

Food shields are used in these types of establishments to protect food from contamination, particularly with respect to bodily fluids and bacteria that may be inadvertently spread as patrons obtain food from a buffet. Food shields also provide patrons with a secure sense that open food containers are protected. As such, most, if not all, cafeterias, restaurants and smorgasbords are required to install food shields to meet standards set by national and local health codes.

Some health codes provide different standards for food shields, depending upon the primary use of the food shield. For example, code standards may be different for shields used for buffets where food service professionals plate food (operator-serviced), as opposed to food shields used for buffets where patrons serve themselves (self-serviced). Manufacturers of food shields offer adjustable food shields, which allow food shields to adapt to either type of primary use.

Food shields also are used by eateries to provide aesthetic value to buffets. In some instances, food shields may be used as a key design element in buffet presentation such that the food shield design adds to the overall ambiance of a buffet. From a merchandising perspective, some food shields make buffets appear highly professional and present food in a more appetizing, attractive and favorable light.

Various types of food shields are known, including those that provide both adjustable and aesthetic features. Nonetheless, there is still a need for improved food shields that meet or exceed health code requirements, provide improved adjustability, and further lend to the aesthetic value of food presented and served "buffet-style." The present invention fulfills these needs and provides further related advantages, as described herein.

BRIEF SUMMARY

According to one preferred embodiment, an adjustable food shield includes shield panel support structures mounted to and extending from a mounting surface, one or more shield panels positioned between at least two support structures, and a plurality of adjustment bracket assemblies coupled to each support structure for adjustment of the shield panels. Each shield panel support structure includes posts or legs coupled to a countertop surface of a buffet table or cart. Each shield panel preferably comprises a semi-transparent or transparent material. A shield panel may be position adjusted and/or angularly adjusted between the shield panel support structures using various elements of the adjustment bracket assemblies.

For position adjustment of a shield panel along the length of the support structure or post, each bracket assembly may include a collar having an outer collar portion, an inner collar portion, preferably a grip element positioned at least partially between the outer and inner collar portions, and a tightening element that tightens the connection of the collar against posts of the shield panel support structure. Or, a bracket assembly may include a collar having an outer collar portion with male connector, an inner collar portion with female connector and multiple tightening elements to hold the collar portions around the post of the shield panel support structure.

For angular adjustment, a bracket assembly includes an indexing base, a rotatable arm assembly with an indexing hub, and a removable or retractable coupling element such as a pin, screw, or rod. The rotatable arm assembly via the indexing hub rotates with respect to an axle bolt axis and the outer collar portion includes a series of holes, slots or recesses spaced apart in an array such that the removable or retractable coupling element engages with a respective hole, slot or recess of the indexing hub.

Each bracket assembly also includes a panel slide rod having panel holding clamps at each end, with each panel holding clamp fastening onto an outer edge of a shield panel. The panel slide rod preferably has at least one flat exterior face, and such rod is inserted through a rod support integral with or joined to the bracket assembly or the rotatable arm assembly of a bracket assembly. The rod support may have a flat outer face adapted for contact with a face of a shield panel for supporting and/or stabilizing the shield panel (in addition to the holding function of the panel holding clamps).

For improved aesthetics and improved coupling of the panel holding clamp to the shield panel, the shield panel preferably include semi-opaque surfaces at the shield panel ends.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
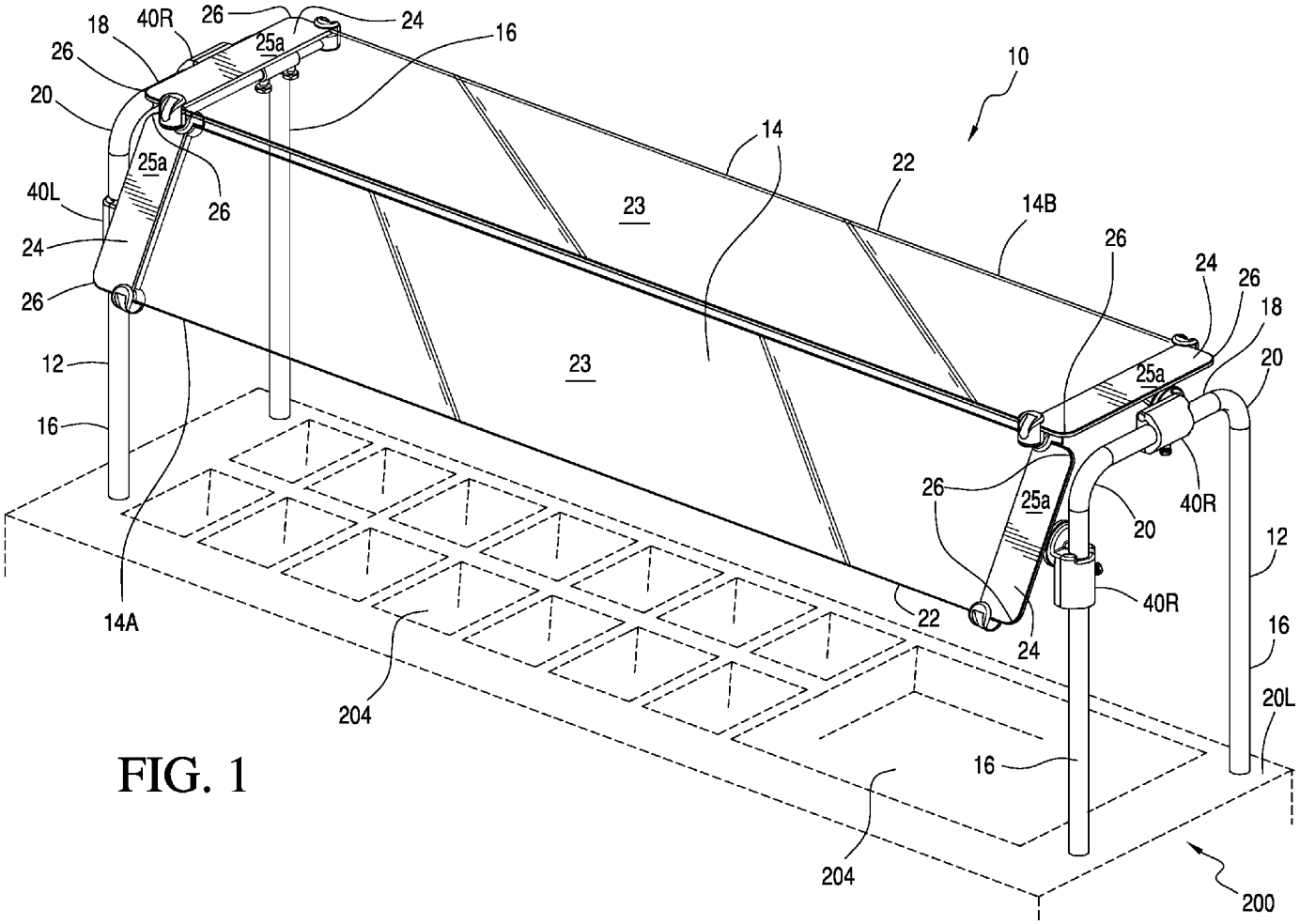
FIG. 1 is a right front perspective view of a food shield in accordance with an embodiment of the invention.

Reference will now be made in detail to the present embodiment of the invention illustrated in the accompanying drawings. The same or like reference numbers may be used in the drawings to refer to the same or like features. It should be noted that the drawings are in simplified form and not drawn to a precise scale.

In reference to the disclosure herein, for purposes of convenience and clarity only, directional terms such as top, bottom, above, below, front, rear, right, left, inner, and outer, are used with respect to the accompanying drawings. Such directional terms used in conjunction with the following description of the drawings should not be construed to limit the scope of the invention in any manner not explicitly set forth herein. Unless specifically set forth herein, the terms "a", "an" and "the" are not limited to one element but instead should be read as meaning "at least one". The terminology includes the words noted above, derivatives thereof and words of similar import.

Turning in detail to the drawings, FIG. 1 shows one embodiment of a food shield 10, including two shield panel support structures 12, two shield panels 14 (with a front shield panel 14A being angularly positioned with respect to a food serving structure 200 and a top shield panel 14B being laterally positioned with respect to the food serving structure 200), extending between the two shield panel support structures 12, and a plurality of adjustment bracket assemblies 40L (positioned on the left side of the food serving structure 200), 40R (positioned on the left side of the food serving structure 200) (generally 40) used for both height or vertical adjustment and angular adjustment of at least one shield panel 14. The shield panel support structures 12 are mounted to and extend upwardly from a food serving structure 200, such as a buffet, cart or table with a mounting surface 202 suitable for serving food (not shown). Such food serving structures 200 may include food receiving receptacles 204 of various sizes, contained within the food serving structure 200. Other types of receptacles (not shown) may also be positioned above the mounting surface 202 and under the food shield.

Each shield panel support structure 12 preferably is configured to have a substantially u-shape. Shield panel support structures may, however, be provided in other shape configurations. Other shape configurations include, but are not limited to a singular and substantially vertical post and I-shaped, pentagonal, trapezoidal, or other polygonal shape configurations. When configured to have a substantially u-shape, each support structure 12 preferably includes side posts 16 and a bridge element 18, extending above the food serving structure 200 and between the side posts 16. Bend elements 20 are preferably positioned and coupled to side posts 16 and the bridge element 18. The support structure 12 may further include connection elements (e.g. screws and/or mounting plates, not shown) that facilitate connection to the food serving structure 200, which are positioned below the food serving structure 200.

Each support structure 12 and its respective elements 16, 18, 20 preferably are manufactured from non-oxidizing metallic-based or aluminum-based materials. Support structures 12 may be manufactured as a unitary piece, or the support structure elements 16, 18, 20 may be connected together via mechanical (e.g., complementary threads or welding) or chemical (e.g., adhesives) methods. Support structure elements 16, 18, 20 preferably are manufactured from hollow rod materials with a substantially circular cross-section (See, e.g., FIGS. 9 and 10).

Figure 4:
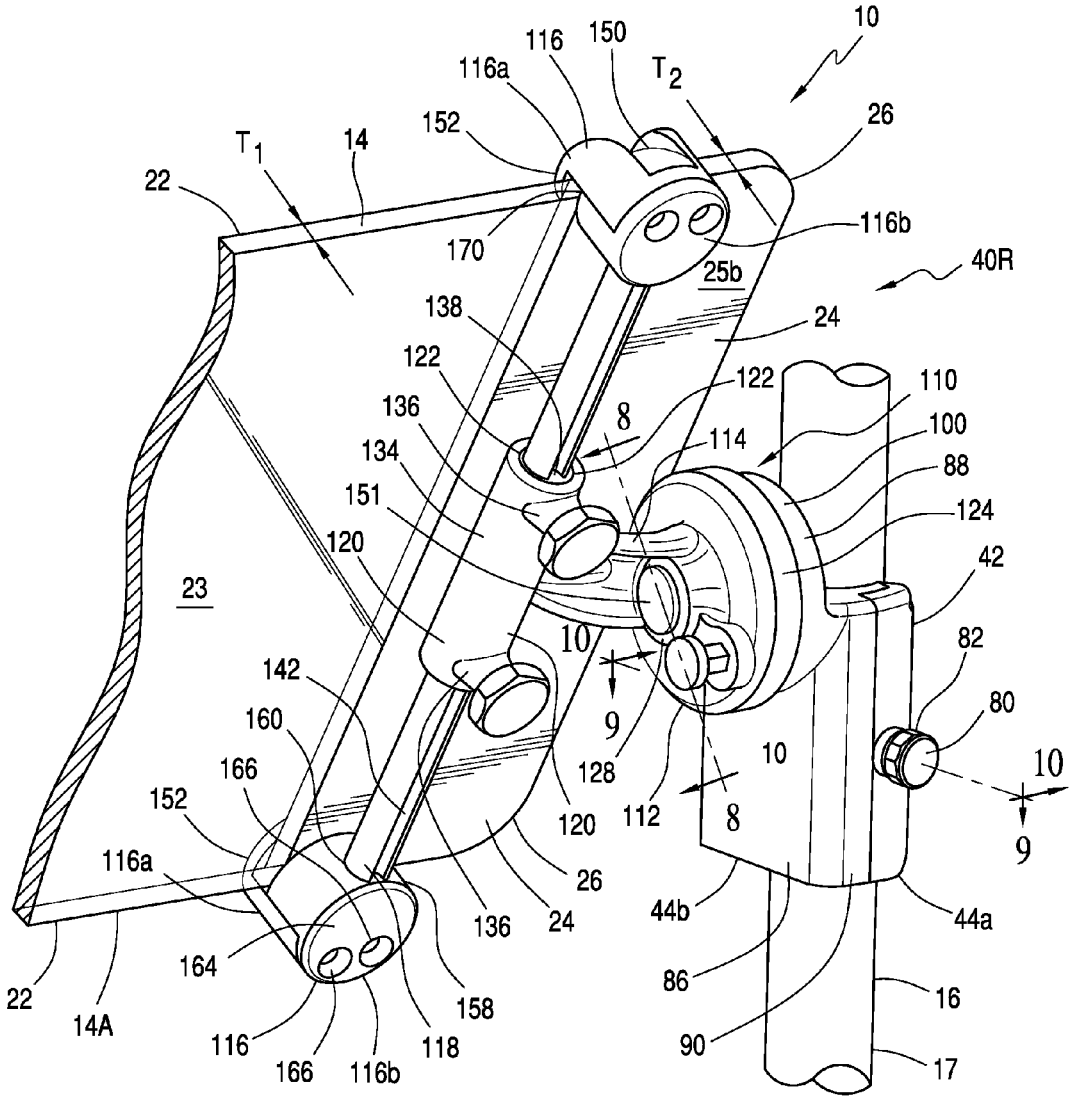
FIG. 4 is an enlarged partial section of a rear perspective view of the food shield shown in FIG. 1.

Upon assembly, the food shield 10 preferably includes one front shield panel 14A coupled to the support structure 12 for angular and vertical or height adjustment, and one top panel 14B laterally positioned laterally above the receptacles 204 of the food serving structure 200 for angular and/or location adjustment. Each shield panel 14 has a panel body 22 with a substantially rectangular configuration. Preferably the panel body 22 includes a transparent or substantially transparent central section 23, semi-opaque or opaque end sections 24, and rounded edges 26. Each shield panel 14 also preferably has a substantially uniform thickness $T_1$ (FIG. 4) along at least the length of the substantially transparent central portion.

Where a shield panel 14 includes semi-opaque or opaque end sections 24, the end sections 24 may be applied with a frosted or semi-opaque element 30. The frosted or semi-opaque element 30 may be applied as a coating or film on the upper and lower surfaces 25*a*, 25*b* of the end sections 24 such that each end section 24 is provided with a thickness T2 (FIG. 4). Materials used for the frosted or semi-opaque elements 30 include, but are not limited to synthetic resins or other plastic materials manufactured in whole or in part from polyvinyl chloride or related polymer. Alternatively, the opaque or opaque end sections 24 may result from mechanically or chemically altering the shield panel material. Such altering may occur my sandblasting or etching shield panel materials. Shield panel materials include, but are not limited to, glass, acrylic, and PLEXIGLAS® sheet materials, and particularly sheet materials manufactured for durability within food service environments.

Shield panels 14 may be manufactured in various lengths. Standard lengths typically have a minimum length of about 8" (inches) and a maximum length of about 8' (feet). Standard thicknesses typically are a minimum thickness of about 0.25" (inches) and a maximum thickness of about 0.5" (inches).

As shown particularly in FIGS. 2, 3, 6, and 7, shield panels 14A, 14B are coupled to adjustable bracket assemblies 40L, 40R. Preferably, end sections 24 of each shield panel 14A, 14B are coupled to each adjustable bracket assembly 40L, 40R, as shown particularly in FIG. 1. Each adjustable bracket assembly 40L, 40R includes elements that couple to side posts 16 of respective shield panel support structures 12 for height or vertical position adjustment with respect to side posts 16 and angular adjustment with respect to each shield panel 14.

Figures 6, 7:
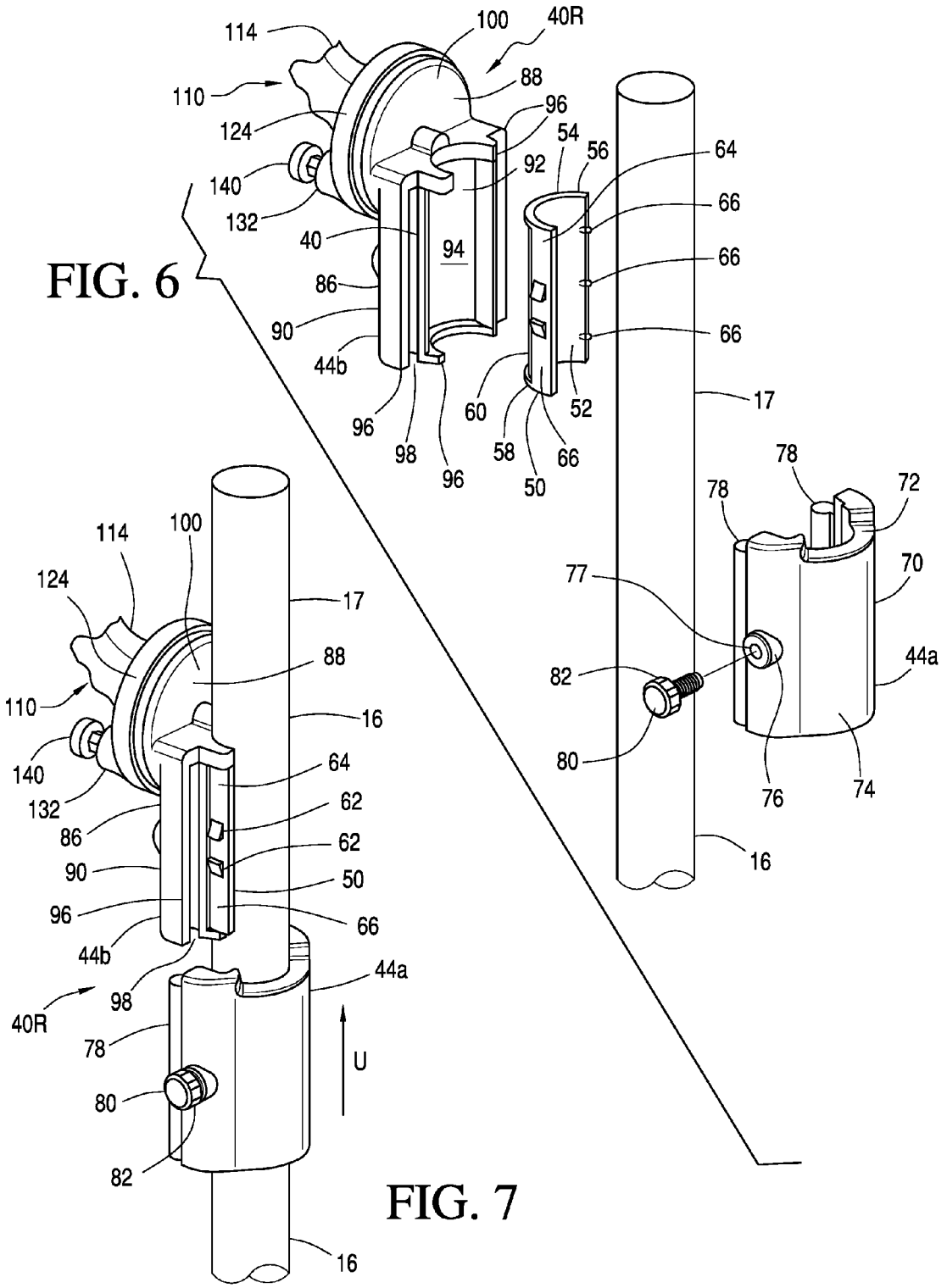
FIG. 6 is a partially exploded right perspective view of a portion of a bracket post assembly.
FIG. 7 is a partially assembled right perspective view of the portion of the bracket post assembly shown in FIG. 6.

For purposes of illustration, FIGS. 6 and 7 show perspective views of adjustable bracket assemblies 40R, which are positioned on the right side of the food shield 10 shown in FIG. 1. It should be understood, however, that elements of the adjustment bracket assemblies 40R positioned on the right side of the food shield 10 are mirror images of the adjustment bracket assemblies 40L positioned on the left side of the food shield 10. See FIGS. 2 and 3.

Figure 3:
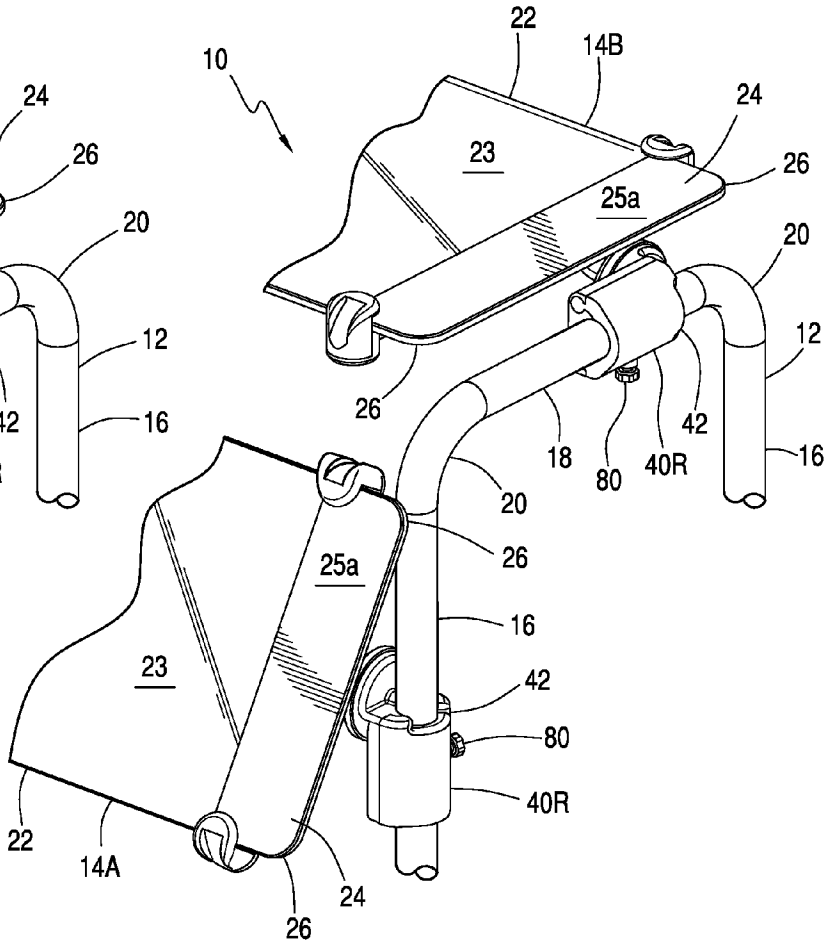
FIG. 3 is the enlarged partial section of the food shield shown in FIG. 2 with food shield panels in different orientations along the post.
Figure 2:
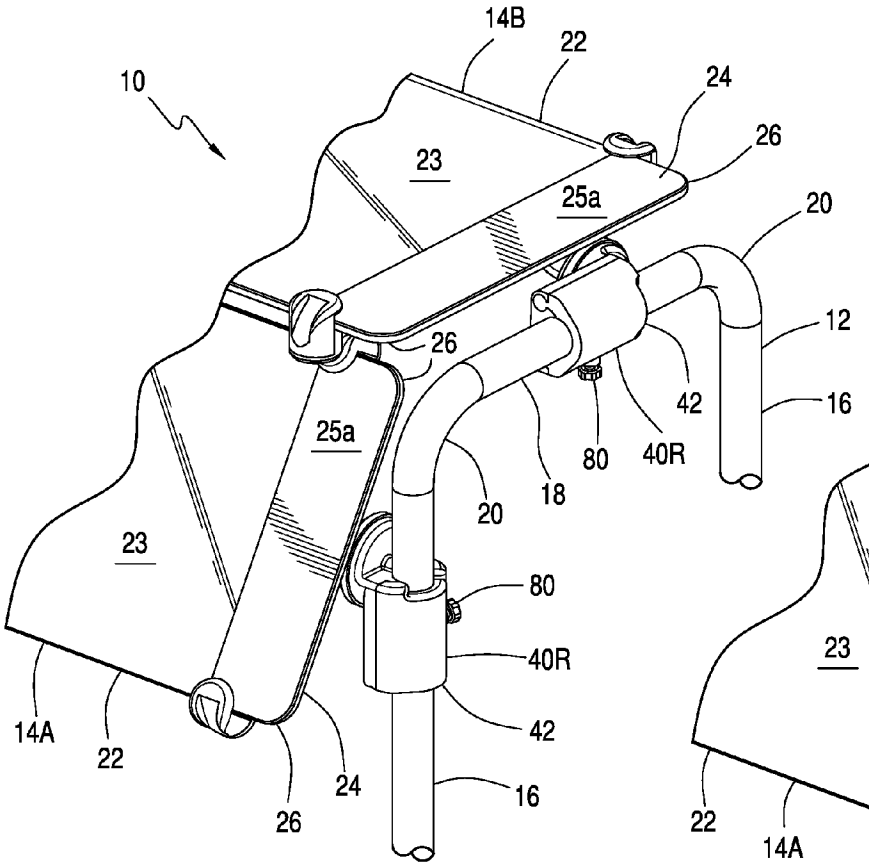
FIG. 2 is an enlarged partial section of the right side of the food shield shown in FIG. 1.

FIGS. 2, 3, 5, 6, 7, and 9, particularly, show various elements of adjustable bracket assemblies 40R that allow for position adjustment. FIG. 2 shows the adjustable bracket assemblies 40R in initial positions with front edges of the panels 14A, 14B closely adjacent or overlapping one another. FIG. 3 shows panels 14A, 14B in second positions after adjustment of each bracket assembly 40R. Specifically, in the second position shield panel 14A has been positioned downward and shield panel 14B has been positioned towards the right of the bridge element 18. In the second positions, the front edges of the panels 14A, 14B are spaced apart from one another.

Each bracket assembly 40R includes a collar 42, having at least two separable collar portions (FIGS. 5, 6, 7, and 9)—an outer collar portion 44*a* and an inner collar portion 44*b*. In addition, a grip element 50 (FIGS. 6, 7, 9, and 10), having an inner surface element 52, also preferably is disposed at least partially within both collar portions 44*a*, 44*b* when the collar 42 is fully assembled (See FIGS. 9 and 10). The inner surface element 52 is provided to enhance the "grip-ability" of the grip element 50 with a side post 16. As used herein, the term "grip-ability" refers to the ability of the inner surface element 52 to improve the frictional resistance of inner surfaces of the grip element with outer surfaces of side posts 16, a bridge element 18, or any other surface to which the adjustable bracket assembly is coupled. Preferably, the inner surface element 52 is an elastomeric material that is overmolded onto the grip element 50 to prevent slippage of the bracket assembly 40R after assembly and prevent sliding adjustment.

Figure 9:
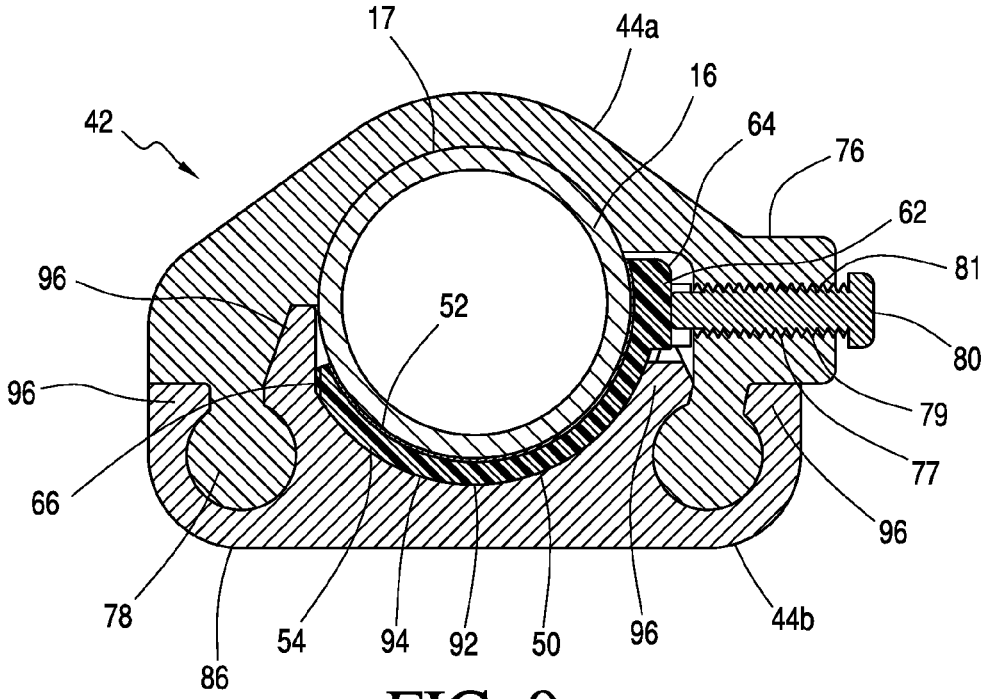
FIG. 9 is a cross-sectional view of the fully assembled bracket post assembly of the food shield shown in FIG. 4, taken along line 9-9 of FIG. 4.
Figure 10:
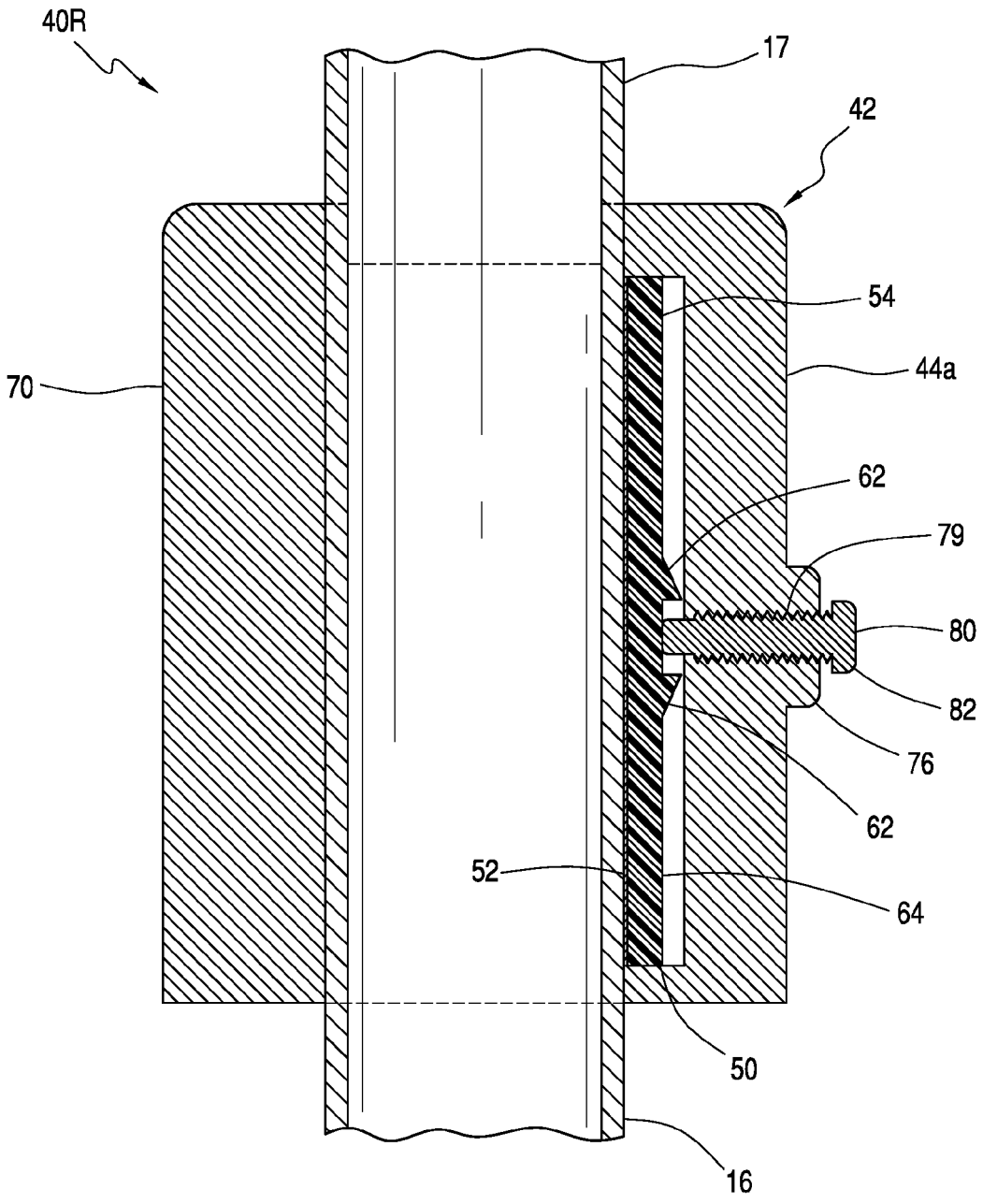
FIG. 10 is a cross-sectional view of the fully assembled bracket post assembly of the food shield, shown in FIG. 4, taken along line 10-10 of FIG. 4.

The grip element 50 is positioned between the outer and inner collar portion 44*a*, 44*b*, as shown particularly in FIGS. 9 and 10, to facilitate coupling of the bracket assembly 40R with a side post 16 of the shield panel support structure 12. Referring particularly to FIGS. 6, 7, 9, and 10, the grip element 50 is shown having an elongated body 54, with upper and lower rims 56, 58 (FIG. 6), an outer recess 60 (FIG. 6), locators 62 positioned on a side face 64 of the body 54, and grip tabs 66 positioned on the opposite side face 68 along the length of the body 54. The upper and lower rims 56, 58 and the outer recess 60 of the grip element 50 are configured to fit within the outer collar portion, as shown in FIG. 7. The side face 64 and locators 62 are positioned outside of the outer collar portion 44*a* for locating a post tightening element 80 when the collar 42 is fully assembled. (See FIGS. 9 and 10). Grip tabs 66 are positioned on the opposite side face 68 of the grip element 50 to further facilitate coupling the grip element 50 upon fully assembly of the collar 42. In this embodiment, the grip element 50 also is provided with an arc-shape, as shown in FIG. 9.

Referring particularly to FIGS. 6, 7, 9 and 10, the outer collar portion 44*a* of the collar 42 includes an elongated outer portion body 70, having an inner contoured surface 72, an outer-facing contoured surface 74, a boss 76 extending from the outer contoured surface 74, a thru-section 77 extending through the body 70 and the boss 76, and male mating elements 78. The inner contoured surface 72 has a semi-circular profile that complements the outer surface 17 of the side post 16. The thru-section 77 includes threads 79 for coupling with a post tightening element 80. The post tightening element 80 preferably is configured as a set screw with threads 81 or a pin, having a grippable end 82 such that rotation of the tightening element 82 causes the body 70 of the collar portion 44*a* to move toward the post 16. As the tightening element 82 moves toward the post 16, the fit between the post 16, the outer collar portion 44*a*, and the post tightening element 82 increases.

The inner collar portion 44*b*, as shown particularly in FIGS. 4-9 includes a location or position adjustment section 86 and an angular adjustment section 88. The location or position adjustment section 86 mates with grip element 50 and the outer collar portion 44*a*. Referring particularly to FIGS. 6 and 9, the adjustment section 86 includes an elongated inner portion body 90, having an inner cavity 92 configured to receive the grip element 50, an inward-facing contoured surface 94, and coupling elements 96 that extend to form female cavities 98 for slidable engagement with male mating elements 78 of the outer collar portion 44*a*. FIG. 7, in particular, shows how male mating elements 78 of the outer collar portion 44*a* slidably engage within female cavities 98 of the inner collar portion 44*b*. Preferably, during assembly the outer collar portion 44*a* is first positioned on a post 16 below the inner collar portion 44*b*. Next, the outer collar portion 44*a* is slidably moved, indicated by an arrow U, shown in FIG. 7, towards the inner collar portion 44*b*. As the outer collar portion is moved in the direction U, male mating elements 78 engage within female cavities 98, coupling the inner and outer collar portions 44*a*, 44*b* together. To secure the position of the collar 42 on its respective post 16 (or alternatively on a bridge element 18), the post tightening element 80 is fitted against the post 16.

Figure 5:
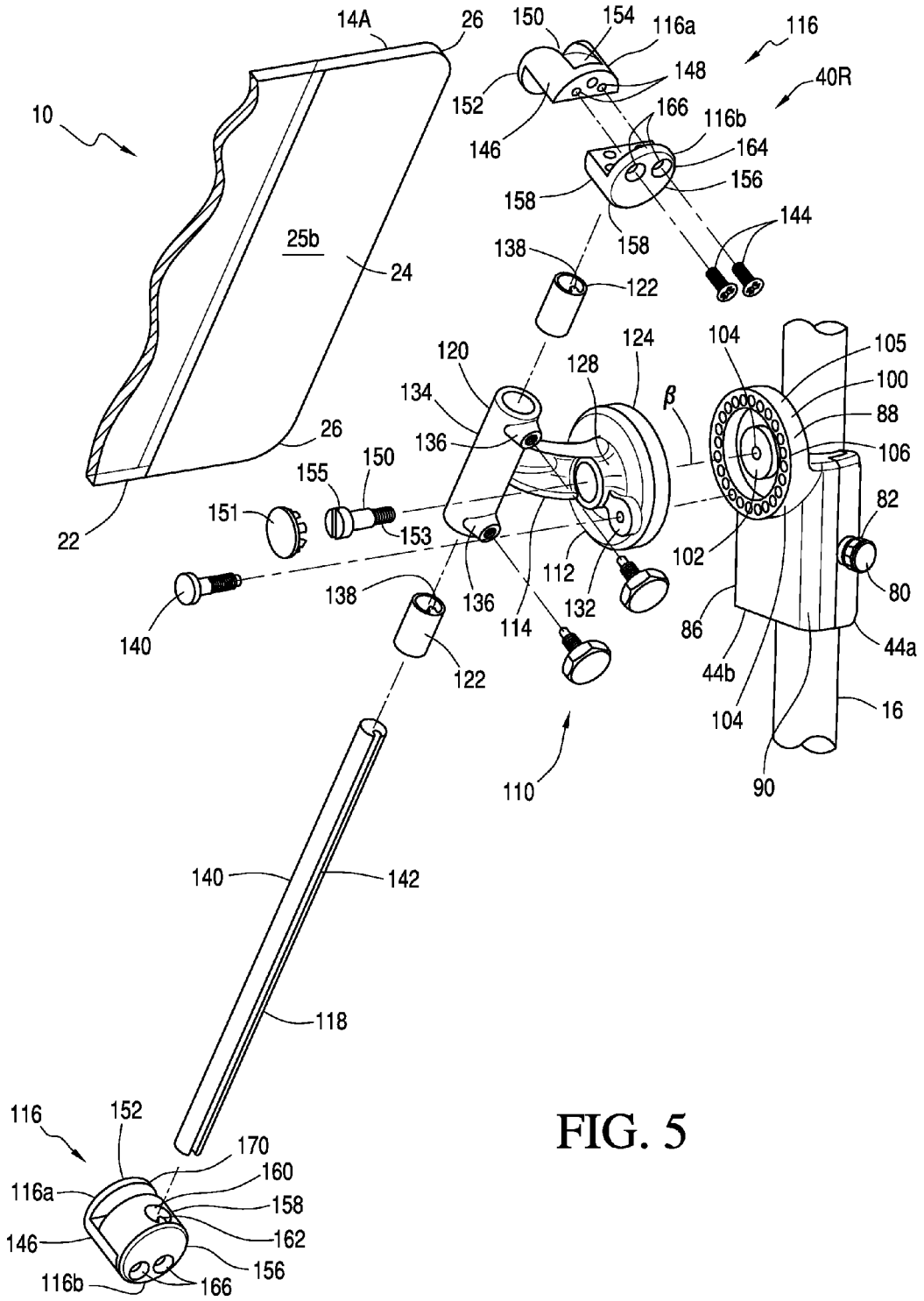
FIG. 5 is an exploded view of the enlarged partial section of the food shield shown in FIG. 4.
Figure 8:
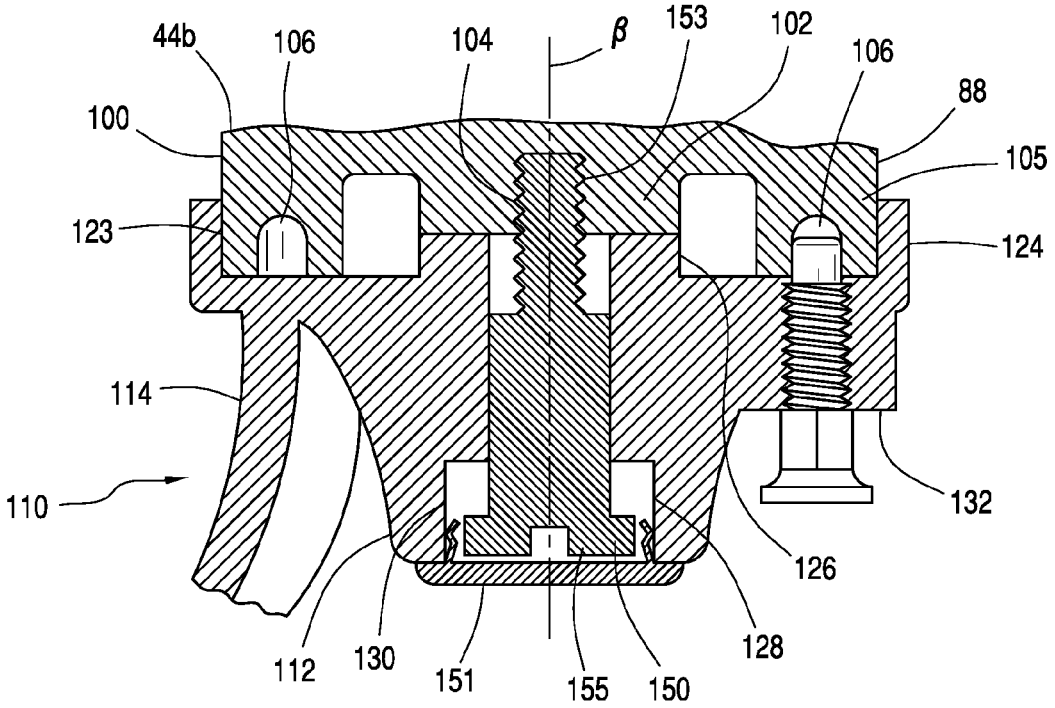
FIG. 8 is a cross-sectional view of the fully assembled bracket post assembly of the food shield shown in FIG. 4, taken along line 8-8 of FIG. 4.

Elements of the adjustable bracket assembly 40R that provide angular adjustment of the shield panel 14A are shown particularly in FIGS. 4, 5 and 8. Such elements include the angular adjustment section 88 of the inner collar portion 44*b* and the rotatable arm assembly 110. Referring particularly to FIGS. 5 and 8, the angular adjustment section 88 of the inner collar portion 44*b* includes an indexing base 100, having a central base portion 102 with an axle bolt receiving hole 104, and an outer base portion 105 with receiving holes, slots or recesses 106. Preferably, the receiving holes, slots or recesses 106 are radially and symmetrically positioned in an array within respect to a base-axle axis β (FIG. 5).

As shown particularly in FIGS. 4, 5 and 8, the rotatable arm assembly 110 includes an indexing hub 112 that couples with the indexing base 100, an extension arm 114 extending from the indexing hub 112, a panel clamp assembly 116, a panel support rod 118, a support rod receiving element 120 coupled to the extension arm 114, and support rod bushings 122 that slidably engage within the support rod receiving element 120. The indexing hub 112 is provided with a bored cavity 123 that mates with the indexing base 100 such that the indexing hub 112 has an outer hub rim 124 positioned around the indexing base 100 upon assembly. The indexing hub 112 also includes a central boss 126 (FIG. 8), an axle bolt boss 128, a counterbored axle bolt hole 130, and a side boss 132 extending from the axle bolt boss 128. The central boss 126, the axle bolt boss 128, and the counterbored axle bolt hole 130 all couple with an axle bolt 150 that mates the rotatable arm assembly 110 with the angular adjustment section 88 of the inner collar portion 44*b*. The axle bolt 150 includes a threaded end 153 received within the axle bolt receiving hole 104 of the central base portion 102. Optionally, an end cap 151 may be coupled to the head 155 of the axle bolt 150. The end cap 151 may include decorative elements (not shown) that further lend to the aesthetic value of the food shield 10.

To rotate the rotatable arm assembly 110, the rotatable arm assembly 110, the axle bolt 150, and the indexing hub 112 are assembled with a clearance fit such that the rotatable arm assembly 110 is able to rotate with respect to base-axle axis β (FIG. 5). To lock the rotatable arm assembly 110 in place, a removable or retractable coupling element 140 (e.g., pin, screw, or rod) is positioned within a receiving hole or recess 106. When alternative positioning of the shield panel 14 is desired by a user, the rotatable arm assembly 110 is rotated clockwise or counterclockwise and the removable or retractable coupling element 140 is repositioned and placed in another receiving hole, slot or recess 106. As shown particularly in FIG. 5, the receiving holes, slots or recesses 106 are spaced apart in an array such that the removable coupling element 140 engages with a respective hole, slot or recess of the indexing hub 112, and thereby providing angular adjustment of the shield panel 14/14A.

As shown particularly in FIG. 4, when assembled with the rotatable arm assembly 110, a shield panel 14/14A is supported, in combination, by the panel clamp assembly 116, the panel support rod 118, the support rod receiving element 120, and support rod bushings 122. The support rod receiving element 120 includes a cylindrical body 134 and at least two coupler bosses 136 extending from the cylindrical body 134 having holes 135 for insertion of tightening screws. At least two support rod bushings 122 are preferably positioned within the cylindrical body 134.

Each support rod bushing 122 includes a male coupler 138 that extends inwardly from an inner surface of the bushing 122. The panel support rod 118 has an elongated rod body 140 with a slot 142 having an inner profile complementary to the outer profile of the male coupler 138 such that the slot 142 and the male coupler 138 slidably engage and the outer diameter of the rod 118 slidably fits within each bushing 122, as shown in FIG. 4.

Coupled to each end of the panel support rod 118 is the panel clamp assembly 116, as shown particularly in FIGS. 4 and 5. The panel clamp assembly 116 includes an upper panel clamp 116*a*, a lower panel clamp 116*b*, and clamp fasteners 144 (FIG. 5). The upper panel clamp 116*a* has an L-shaped body 146, upper clamp holes 148 (FIG. 5), and an exterior recess 150 that slopes downward from a top section 152 of the upper panel clamp 116*a*. The exterior recess 150 terminates slightly above the bottom surface of the upper panel clamp 116*a* to form a ridge 154. (See upper panel clamp 116*a* shown in the upper right corner of FIG. 5). The exterior recess 150 and ridge 154 are provided for adjacent positioning of panel clamp assemblies 116, and particularly panel support rods 118, as shown particularly in FIGS. 1 and 2.

The lower panel clamp 116*b* also has an L-shaped body 156. The lower panel clamp 116*b*, however, includes a lower panel clamp portion 158 with a rod receiving hole 160, having a male clamp-rod coupler 162 disposed therein. The male clamp-rod coupler 162 has an outer profile complementary to the inner profile of the slot 142 disposed in the panel support rod 118 such that the rod 118 engages within the coupler 162. The lower panel clamp 116*b* also includes a bottom portion 164, having at least two recessed holes 166 configured to receive clamp fasteners 144 (FIG. 5). When fastened together, each clamp assembly 116 includes a panel receiving slot 170 (See clamp assembly 116 on bottom left corner of FIG. 5) configured to receive end sections 24 of each shield panel 14 (FIG. 4).

When fully assembled, each adjustable bracket assembly 40 provides for both vertical position and angular adjustment of a shield panel 14. Position adjustment of the shield panel 14 is provided by the panel clamp assembly 116 to accommodate shield panels of various sizes and food serving structures of various widths. Position adjustment of an adjustable bracket assembly 40 is provided when assemblies are coupled to posts 16 and/or bridge elements 18 of a shield panel support structure 12. The various elements provided in each bracket assembly 40 lend to the adjustable nature of the food shields, allowing bracket assemblies 40 to be positioned not only upwardly and downwardly, but laterally as well. Moreover, the adjustable bracket assemblies 40 disclosed herein include elements that allow for angular adjustment of shield panels 14/14A further lending to the adjustable nature and aesthetic value of the food shield described herein.

The adjustable bracket assemblies 40R, 40L can be separated from and rejoined to a support post 16 at any location of the support post. Because they are separable into parts, the user does not need to slide the bracket assemblies along a substantial length of a support post 16 to secure the bracket assemblies to a desired location along the support post. The food shields with adjustable bracket assemblies according to the invention thus may be used with any kind of support posts, including support posts 16 as shown, that are contiguous without an open post end.

Referring next to FIGS. 11-17, an alternative embodiment of the food shield 210 has two shield panels 14 joined to support posts 12 (only one post shown in FIG. 11), with a first shield panel 14 attached to an upper section 18 of the post 12 and a second shield panel 14 attached to a vertical section 16 of the post. The shield panels 14 and posts 12 are the same or highly similar to the shield panels 14 and posts 12 of the first embodiment shown in FIGS. 1-10. This alternative embodiment 210 uses different bracket assemblies 240, 340 to join the respective shield panels 14 to the posts 12.

Figure 14:
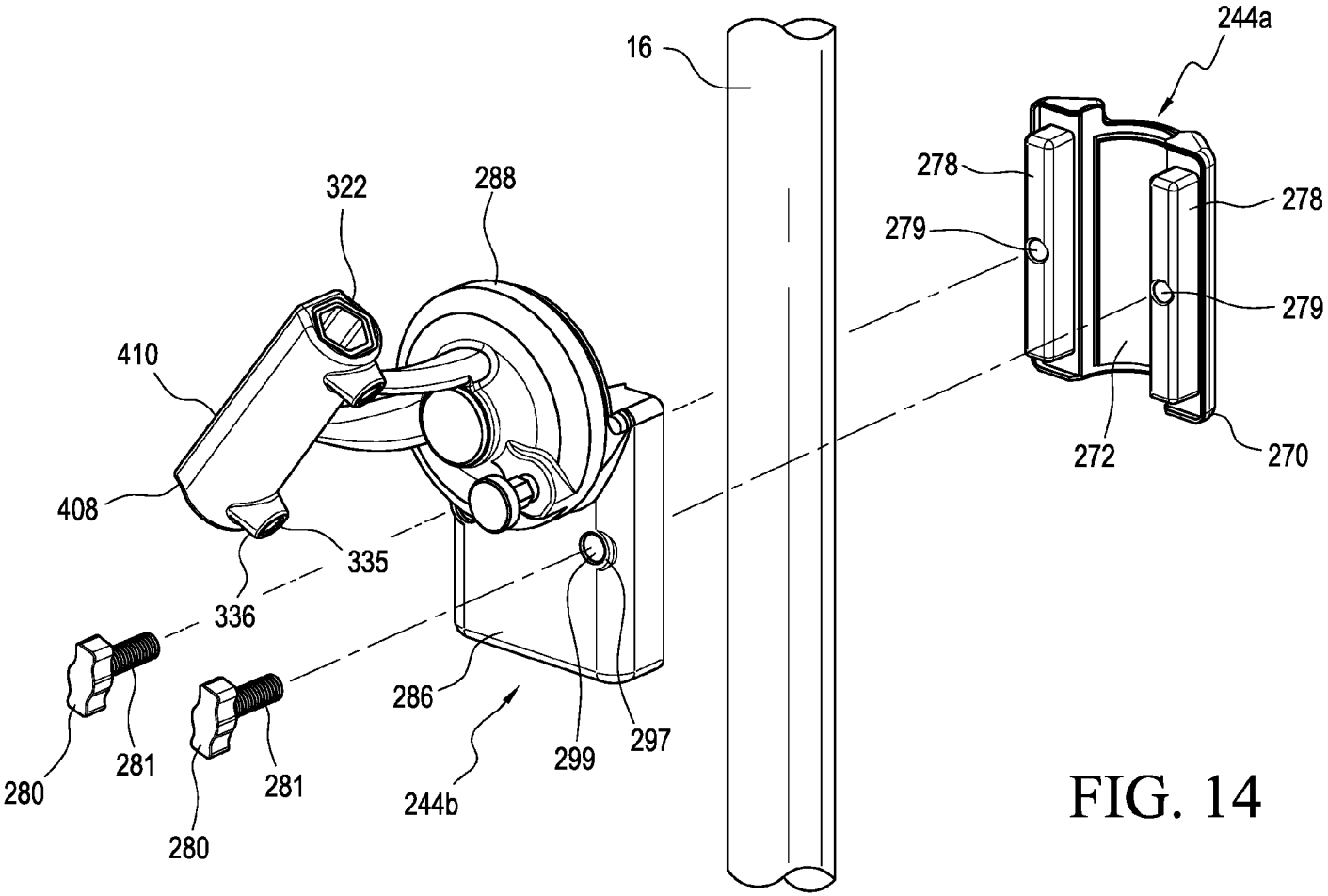
FIG. 14 is a partially exploded right front perspective view of a portion of an alternative embodiment of a bracket post assembly.
Figure 15:
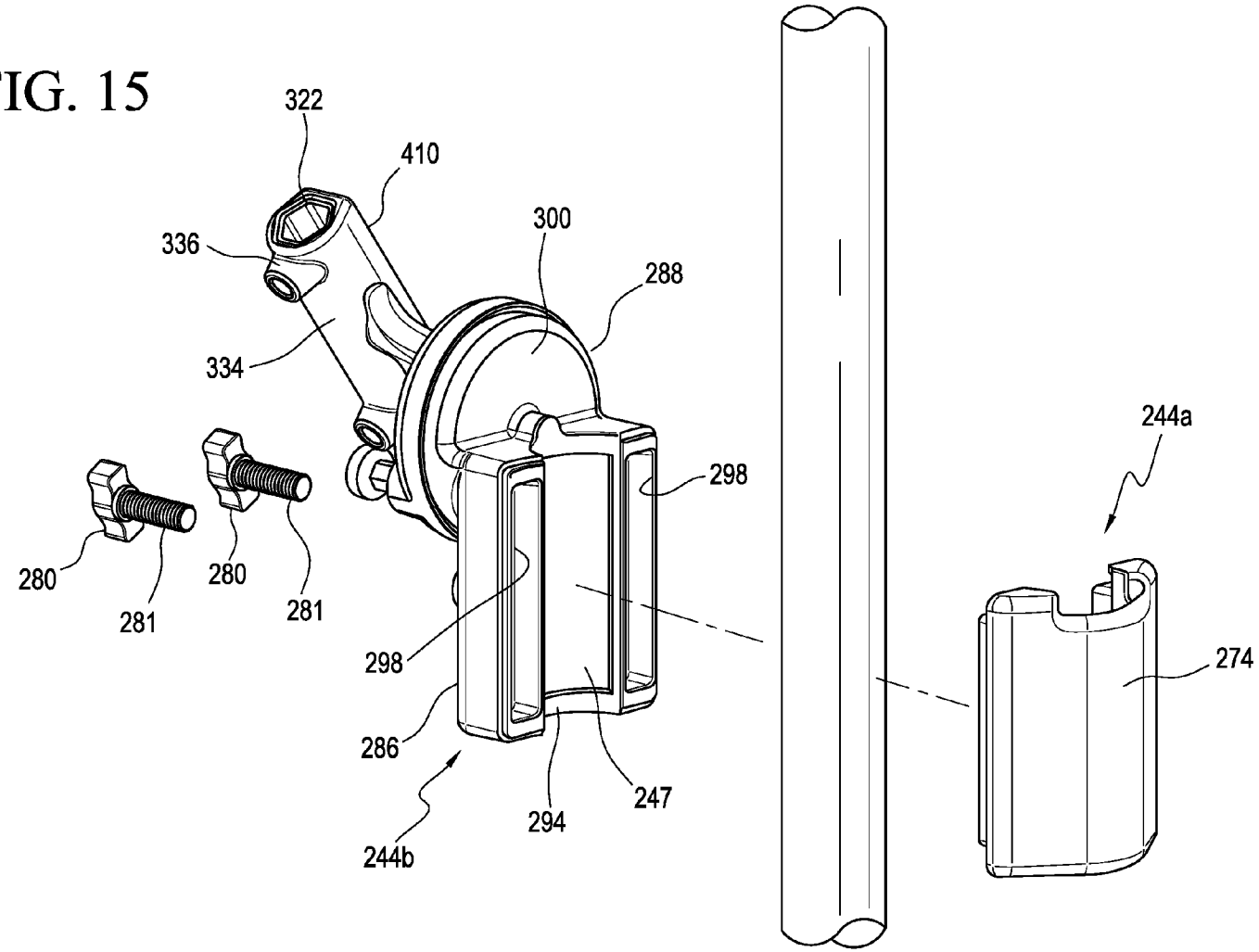
FIG. 15 is a partially exploded left rear perspective view of the portion of the alternative embodiment of a bracket post assembly of FIG. 14.

The first bracket assembly 240 includes a collar 242, having at least two separable collar portions (FIGS. 14-16)—an outer collar portion 244*a* and an inner collar portion 244*b*. Referring particularly to FIGS. 14 and 15, the outer collar portion 244*a* of the collar 242 includes an elongated outer portion body 270, having an inner contoured surface 272 and an outer-facing contoured surface 274. The inner contoured surface 272 has a semi-circular profile that complements the outer surface of the side post 16. Male mating elements 278 extend away from the inner contoured surface 272. The male mating elements 278 are ridges or bars bordering or extending longitudinally on opposite sides of the inner contoured surface 272. Threaded openings 279 are formed into each of the male mating elements 278, and are adapted for coupling with a post tightening element 280. The post tightening element 280 preferably is configured as a set screw with threads 281 or a pin, having a grippable end 282 such that rotation of the tightening element 280 causes the body 270 of the collar portion 244*a* to move toward the post 16. As the tightening element 282 moves toward the post 16, the fit between the post 16, the outer collar portion 244*a*, and the post tightening element 282 increases.

Figure 16:
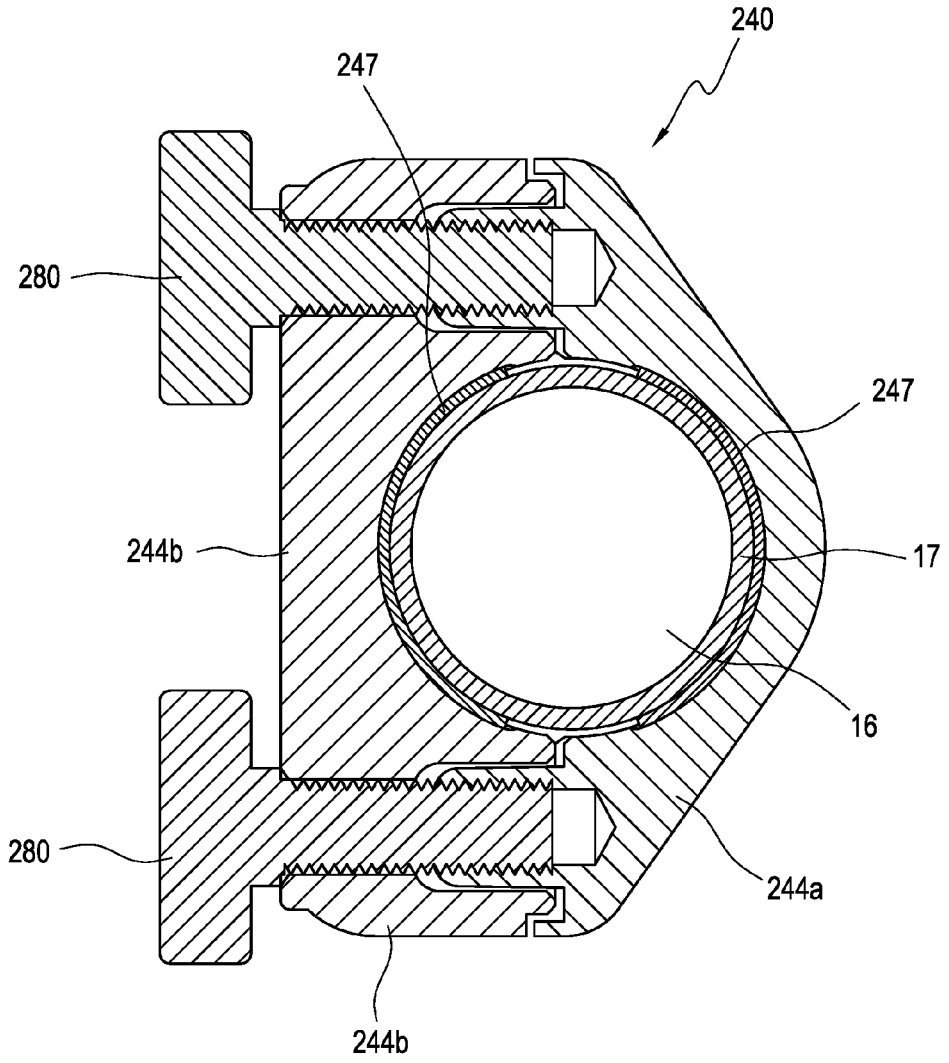
FIG. 16 is a cross-sectional view of the fully assembled alternative bracket post assembly of the food shield shown in FIG. 12, taken along line 16-16 in FIG. 12.
Figure 17:
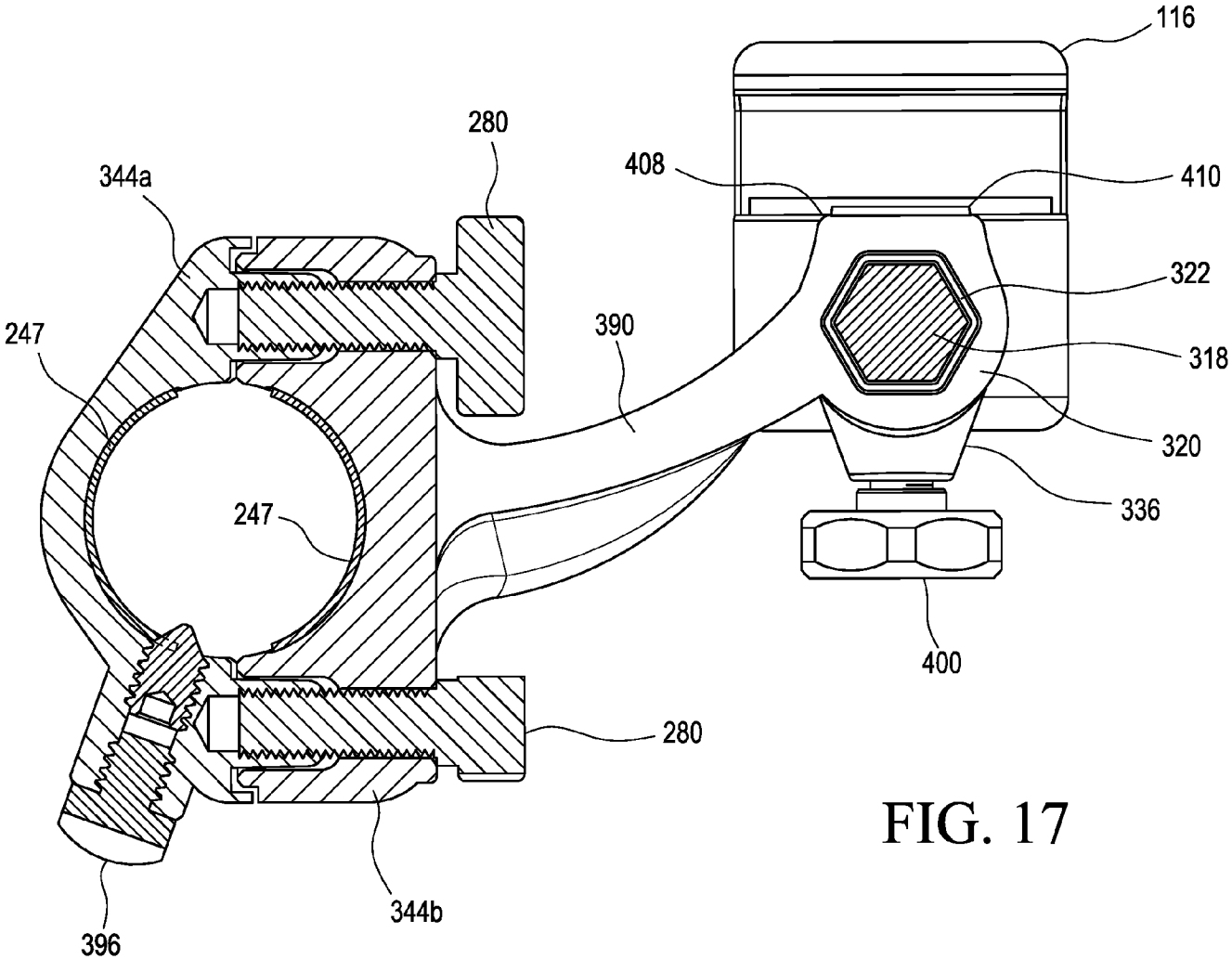
FIG. 17 is a cross-sectional view of the fully assembled alternative bracket post assembly of the food shield shown in FIG. 13, taken along line 17-17 in FIG. 13.

The inner collar portion 244*b*, as shown particularly in FIGS. 14-16 includes a location or position adjustment section 286 and an angular adjustment section 288. The location or position adjustment section 286 mates with the outer collar portion 244*a*. Referring particularly to FIGS. 14 and 15, the adjustment section 286 includes an elongated inner portion body 290, having an inner cavity with an inward-facing contoured surface 294, and walls 296 that extend to the sides of the inward-facing contoured surface 294 and define female cavities 298 for slidable engagement with male mating elements 278 of the outer collar portion 244*a*. The inner collar portion 244*b* further defines threaded through openings 299 that extend through the inner collar portion 244*b* and to the female cavities 298 at respective bosses 297.

A friction material 247 or gasket or shim preferably is installed on the inward-facing contoured surfaces 272, 294 of the outer collar portion 244*b* and inner collar portion 244*a*. The friction material 247 enhances engagement of the collar portions 244*a*, 244*b* to the post 16, or bridge element 18.

Preferably, during assembly the outer collar portion 244*a* is first positioned on a post 16 and the inner collar portion 244*b* next is positioned on an opposite side of the post 16. Next, the inner collar portion 244*b* and the outer collar portion 244*a* are moved toward one another so that the male mating elements 278 engage within female cavities 298, coupling the inner and outer collar portions 244*a*, 244*b* together. To secure the position of the collar 242 on its respective post 16 (or alternatively on a bridge element 18), the post tightening elements 280 are fitted into the threaded through openings 299 of the inner collar portion 244*b* and into the threaded openings 279 of the outer collar portion 244*a*. Tightening of the post tightening elements 280 draw the outer collar portion 244*a* and inner collar portion 244*b* toward one another and in engagement around the post 16.

Figure 11:
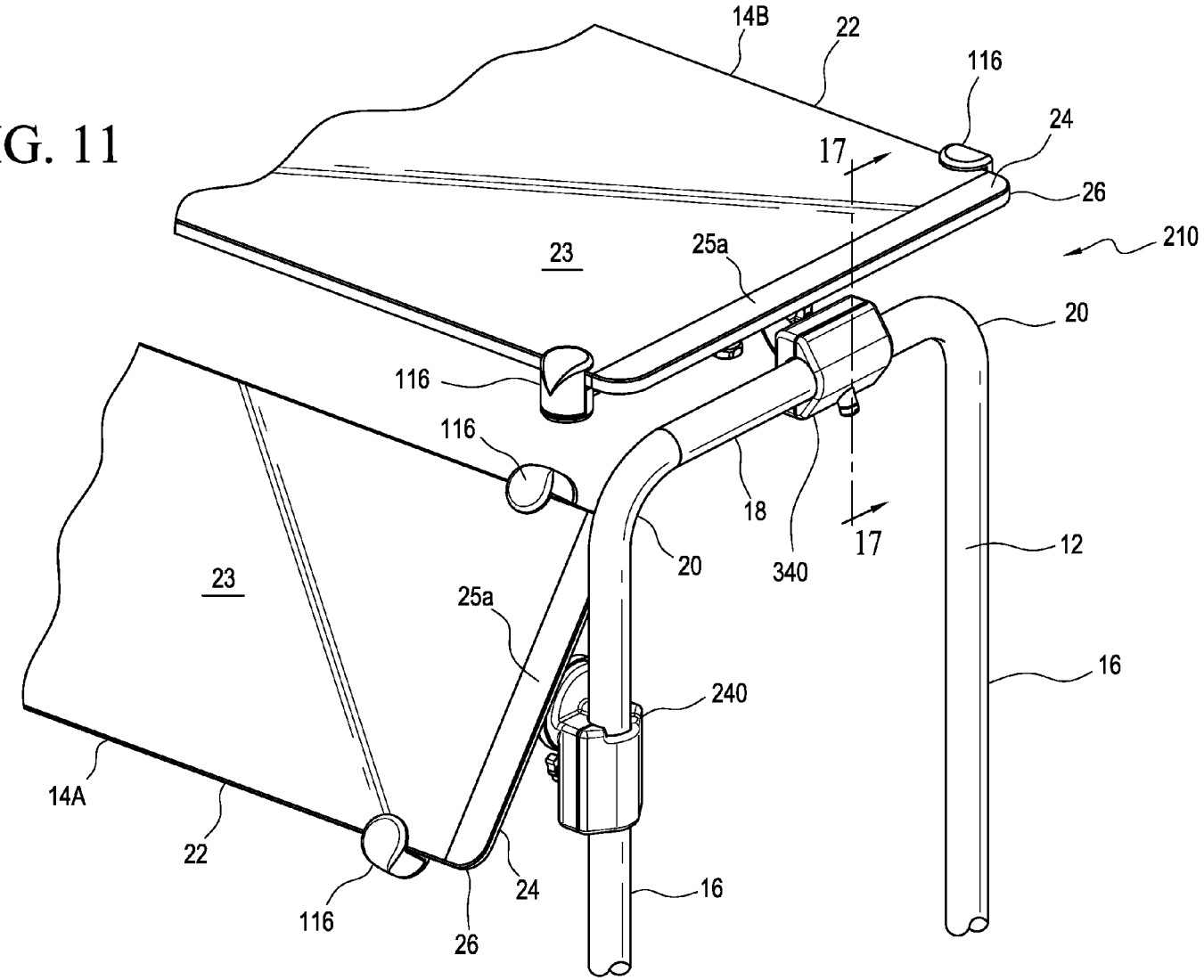
FIG. 11 is an enlarged partial section view of a right side of a food shield of an alternative embodiment.
Figure 12:
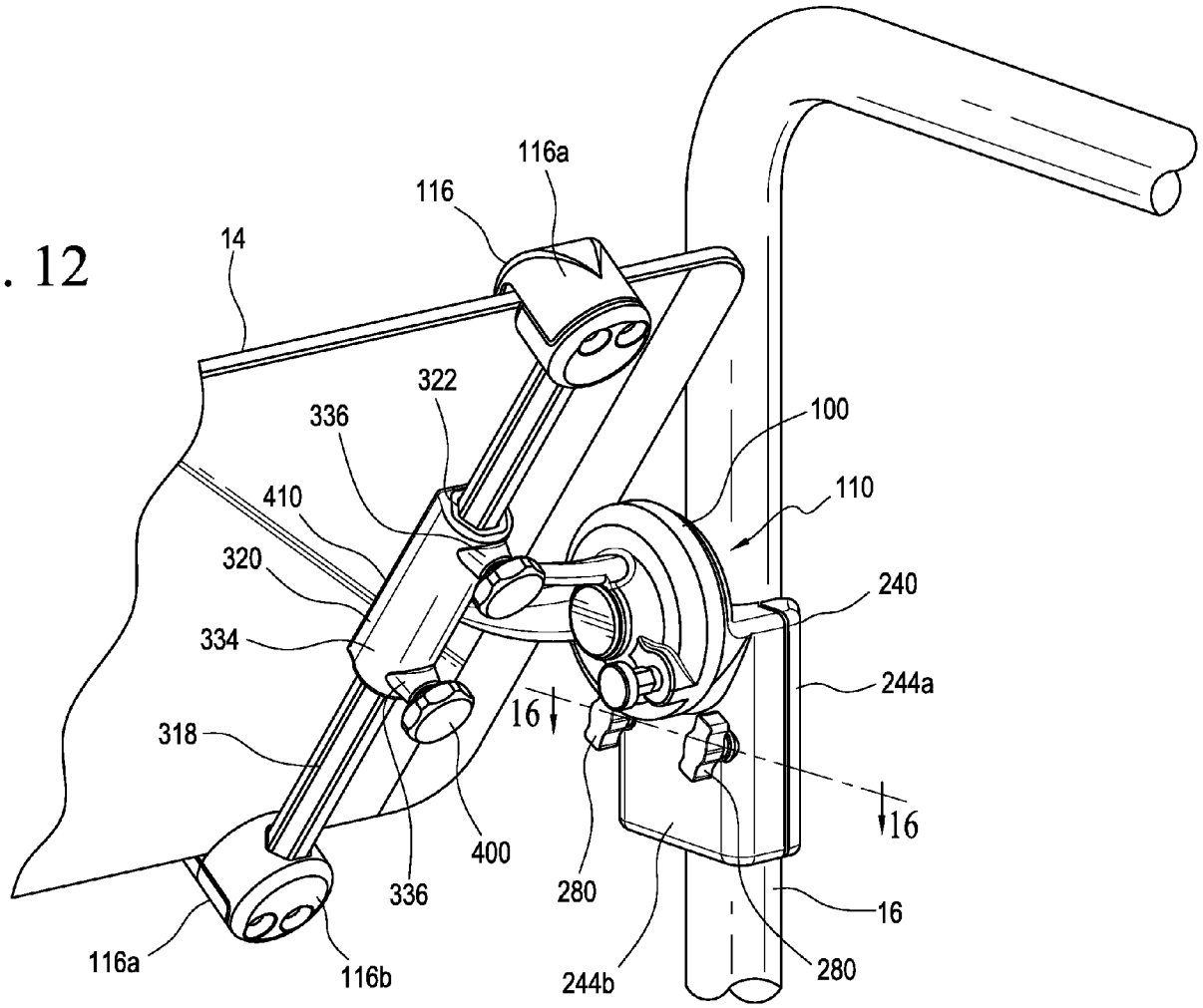
FIG. 12 is an enlarged partial section view of a rear perspective view of the food shield shown in FIG. 11.

Elements of the adjustable bracket assembly 240 that provide angular adjustment of the shield panel 14 are shown particularly in FIGS. 12 and 14 (See also FIG. 5 where like elements of the embodiment of that Figure are present in the embodiment of FIGS. 11-17). Such elements include the angular adjustment section 288 of the inner collar portion 244*b* and the rotatable arm assembly 210. The angular adjustment section 288 of the inner collar portion 244*b* includes an indexing base 100, having a central base portion 102 with an axle bolt receiving hole 104, and an outer base portion 105 with receiving holes, slots or recesses 106. Preferably, the receiving holes, slots or recesses 106 are radially and symmetrically positioned in an array within respect to a base-axle axis β (FIG. 5).

As shown particularly in FIGS. 11 and 12, when assembled with the rotatable arm assembly 110, a shield panel 14 is supported, in combination, by the panel clamp assembly 116, the panel support rod 318, the support rod receiving element 320, and support rod bushings 322. The support rod receiving element 320 includes a cylindrical body 334 and at least two coupler bosses 336 extending from the cylindrical body 334 having holes 335 for insertion of tightening screws 400.

The panel support rod 318 has an elongated rod body with at least one flat side, preferably six flat sides as shown in FIG. 12 where the rod 318 forms a six-sided hex in cross section. The support rod receiving element 320 defines through opening an inner profile of a hex shape adapted to receive the rod 318 with hex cross section. Alternatively, the through opening may have an inner profile shape adapted to receive any alternative configuration of the rod, such as a rod with at least one flat side. This mating fit between the through opening of the support rod receiving element 320 and the support rod 318 hinders or deters rotational movement of the rod when held in the support rod receiving element. In addition, the ends of the tightening screws 400, when the screws are tightened, make contact with the bushing(s) 322 and secure the panel support rod 318 to the support rod receiving element 320.

The support rod receiving element 320 defines at least one flat exterior face 408 that is adapted to face a surface of the shield panel 14. The flat exterior face 408 may be in direct contact with the surface of the shield panel 14. Alternatively, a strip of plastic or friction engaging material 410 may be installed on the flat exterior face 408 for contact with the face surface of the shield panel 14.

Coupled to each end of the panel support rod 318 is the panel clamp assembly 116, as shown particularly in FIG. 12 (see also FIGS. 4 and 5 where like elements have like reference numbers). The panel clamp assembly 116 includes an upper panel clamp 116*a*, a lower panel clamp 116*b*, and clamp fasteners 144 (FIG. 5). The upper panel clamp 116*a* has an L-shaped body 146, upper clamp holes 148 (FIG. 5), and an exterior recess 150 that slopes downward from a top section 152 of the upper panel clamp 116*a*. The exterior recess 150 terminates slightly above the bottom surface of the upper panel clamp 116*a* to form a ridge 154. (See upper panel clamp 116*a* shown in the upper right corner of FIG. 5). The exterior recess 150 and ridge 154 are provided for adjacent positioning of panel clamp assemblies 116, and particularly panel support rods 318.

The lower panel clamp 116*b* also has an L-shaped body 156 in the embodiment of FIG. 12. The lower panel clamp 116*b* also includes a bottom portion 164, having at least two recessed holes 166 configured to receive clamp fasteners 144 (FIG. 12). When fastened together, each clamp assembly 116 includes a panel receiving slot 170 (See clamp assembly 116 on bottom left corner of FIG. 5) configured to receive end sections 24 of each shield panel 14 (FIG. 12).

Figure 13:
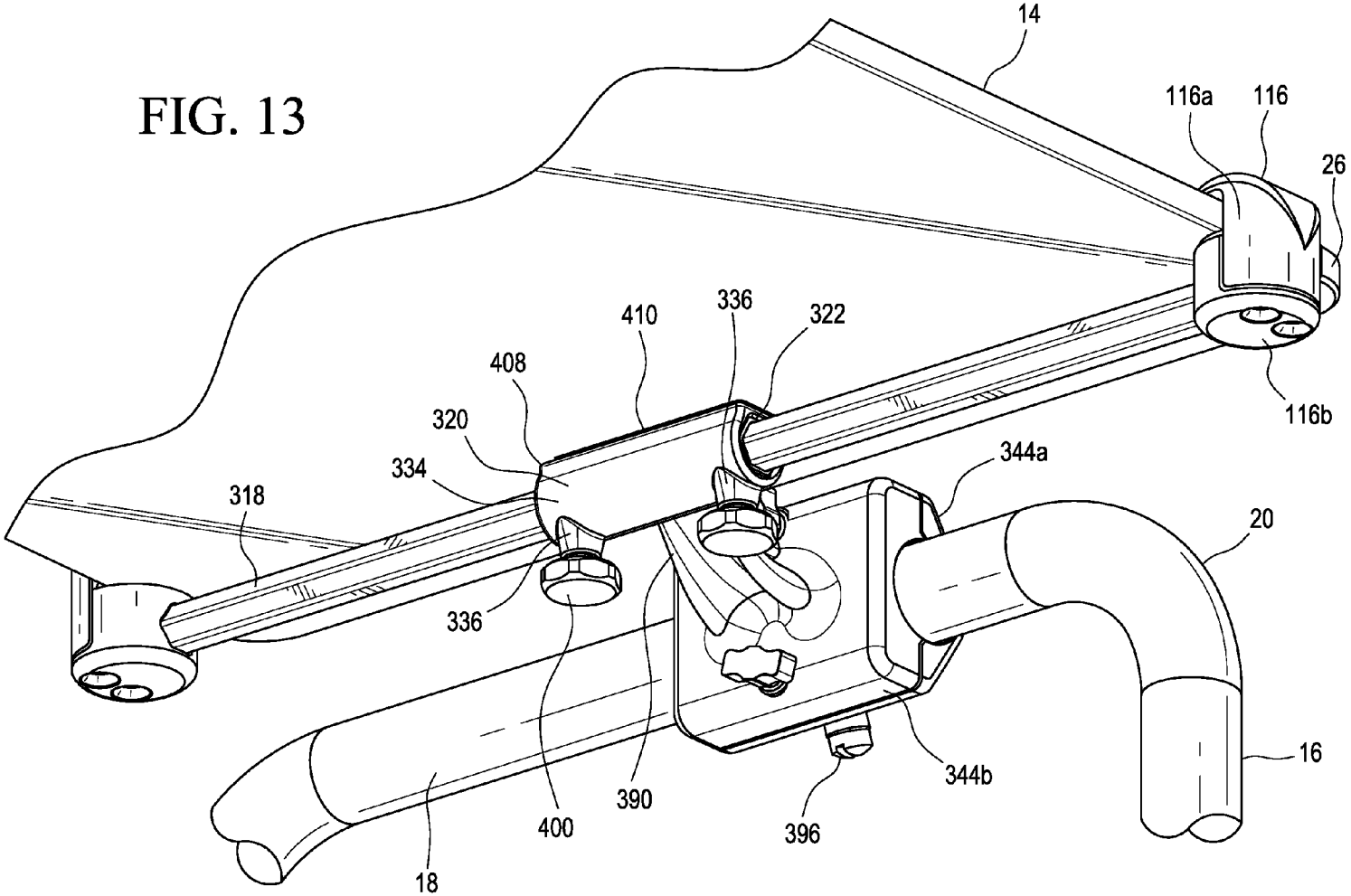
FIG. 13 is an enlarged partial section view of an underside perspective view of the food shield shown in FIG. 11.

Referring now to FIG. 13, the second adjustable bracket assembly 340 is shown. This adjustable bracket assembly 340 includes a collar 342, having at least two separable collar portions—an outer collar portion 344*a* and an inner collar portion 344*b*. The outer collar portion 344*a* of the collar 342 is comparable to the outer collar portion 244*a* of the first adjustable bracket assembly 240. One difference is that the outer collar portion 344*a* defines a threaded through hole adapted to receive a set screw 396.

The inner collar portion 344*b* of the adjustable bracket assembly 340, as shown in FIG. 13, differs from the inner collar portion 244*b* of the adjustable bracket assembly 240 because the adjustable bracket assembly 340 lacks an angular adjustment section 288. Rather, the inner collar portion 344*b* comprises only a location or position adjustment section. The inner collar portion 344*b* mates with the outer collar portion 344*a* in the same manner that the inner collar portion 244*b* mates with the outer collar portion 244*a* of the adjustable bracket assembly 240 shown in FIGS. 12, 14 and 15. The inner collar portion 344*b* includes an elongated inner portion body, having an inner cavity with an inward-facing contoured surface, and walls that extend to the sides of the inward-facing contoured surface and define female cavities for slidable engagement with male mating elements of the outer collar portion. The inner collar portion 344*b* further defines threaded through openings that extend through the inner collar portion 344*b* and to the female cavities at respective bosses.

Preferably, during assembly the outer collar portion 344*a* is first positioned on a post 16 or bridge element 18 and the inner collar portion 344*b* next is positioned on an opposite side of the post 16 or bridge element 18. Next, the inner collar portion 344*b* and the outer collar portion 344*a* are moved toward one another so that the male mating elements engage within female cavities, coupling the inner and outer collar portions 344*a*, 344*b* together. To secure the position of the collar 342 on its respective bridge element 18 (or alternatively on a post 16), the post tightening elements are fitted into the threaded through openings of the inner collar portion 344*b* and into the threaded openings of the outer collar portion 344*a*. Tightening of the post tightening elements draw the outer collar portion 344*a* and inner collar portion 344*b* toward one another and in engagement around the bridge element 18. In addition, set screw 396 is tightened to better grip the bracket assembly 340 to the post 16 or bridge element 18.

This second adjustable bracket assembly 340 lacks the structure to angularly adjust orientation of the shield panel 14. A shield panel 14 is supported, in combination, by the adjustable bracket assembly 340, a panel clamp assembly 116, a panel support rod 318, a support rod receiving element 320, and support rod bushings 322. With the second adjustable bracket assembly 340, the support rod receiving element 320 is joined to the inner collar portion 344*b* by one or more arms 390 that extend away from the inner collar portion 344*b*. In all other respects, the panel clamp assembly 116, panel support rod 318, and the support rod receiving element 320 have the structure described with reference to the first adjustable bracket assembly of FIGS. 12, 14 and 15.

When fully assembled, each adjustable bracket assembly 240, 340 provides for vertical position of a shield panel 14, and adjustable bracket assembly 240 provides for angular adjustment of a shield panel 14. Position adjustment of the shield panel 14 is provided by the panel clamp assembly 116 to accommodate shield panels of various sizes and food serving structures of various widths. Position adjustment of an adjustable bracket assembly 240, 340 is provided when assemblies are coupled to posts 16, 18 of a shield panel support structure 12. The various elements provided in each bracket assembly 240, 340 lend to the adjustable nature of the food shields, allowing bracket assemblies 240, 340 to be positioned not only upwardly and downwardly, but laterally as well. Moreover, the adjustable bracket assemblies 240 disclosed herein include elements that allow for angular adjustment of shield panels 14 further lending to the adjustable nature and aesthetic value of the food shield described herein.

The adjustable bracket assemblies 240, 340 can be separated from and rejoined to a support post 16, 18 at any location of the support post. Because they are separable into parts, the user does not need to slide the bracket assemblies along a substantial length of a support post 16, 18 to secure the bracket assemblies to a desired location along the support post. The food shields with adjustable bracket assemblies according to the invention thus may be used with any kind of support posts, including support posts 16, 18 as shown, that are contiguous without an open post end.

As such, it will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A food shield, comprising:

at least one shield panel adapted to be positioned between two posts and adapted for coupling to the two posts, said shield panel having a front edge, a back edge and opposed end sections and defining a thickness between a front face and an opposite face;

a first panel clamp assembly comprising an upper panel clamp and a lower panel clamp that mates with the upper panel clamp, with the upper panel clamp and lower panel clamp when mated together defining a panel receiving slot of the panel clamp assembly therebetween, such that the at least one shield panel is held between the upper panel clamp and lower panel clamp in the panel receiving slot along the front edge of the at least one shield panel with the upper panel clamp contacting the front face and the lower panel clamp contacting the opposite face, and the at least one shield panel is slidably positionable within the slot defined between the upper panel clamp and the lower panel clamp, until the upper panel clamp and lower panel clamp are tightened to maintain the shield panel in a fixed position;

a second panel clamp assembly comprising a second upper panel clamp, and a second lower panel clamp that mates with the second upper panel clamp, with the second upper panel clamp and second lower panel clamp when mated together defining a second panel receiving slot of the second panel clamp assembly therebetween, such that the at least one shield panel is held between the second upper panel clamp and second lower panel clamp in the panel receiving slot along the rear edge of the shield panel with the second upper panel clamp contacting the front face and the second lower panel clamp contacting the opposite face, and the at least one shield panel is slidably positionable within the slot defined between the second upper panel clamp and the second lower panel clamp, until the second upper panel clamp and second lower panel clamp are tightened to maintain the shield panel in a fixed position;

a first adjustable bracket assembly connecting together the first panel clamp and the second panel clamp and adapted for coupling to the first post, wherein said first adjustable bracket assembly provides location adjustment of the shield panel in respect to the first post, the first adjustable bracket assembly comprising at least two separable collar portions that when joined together form a collar that surrounds the first post;

a panel support rod joined to the first adjustable bracket assembly, wherein the first panel clamp assembly is coupled to or formed at one end of the panel support rod, and the second panel clamp assembly is coupled to or formed at an opposite end of the panel support rod; and a support rod receiving element extending from the first adjustable bracket assembly, said support rod receiving element defining a bore into which the panel support rod is received and defining at least one substantially flat outer surface adapted for contact with either the front face or the opposite face of the shield panel.

2. The food shield of claim 1, further comprising a first grip element positioned at least partially between the separable collar portions of the adjustable bracket assembly, wherein said first grip element has an inner surface that contacts the first post.

3. The food shield of claim 1, wherein the panel support rod has at least one flat outer surface.

4. The food shield of claim 1, wherein the first post defines an axis that extends in a direction vertically from a mounting surface of a food serving structure.

5. The food shield of claim 1, wherein the first post defines an axis that extends in a direction parallel to a display area of a food serving structure.

6. The food shield of claim 1, wherein the first adjustable bracket assembly provides angular adjustment of the shield panel in respect to the first post.

7. The food shield of claim 6, wherein one collar portion comprises a position adjustment section and an angular adjustment section.

8. The food shield of claim 7, wherein the one collar portion and the other collar portion each comprises a mating element that allows for slidable engagement of the one collar portion with the other collar portion.

9. The food shield of claim 7, wherein the angular adjustment section includes an indexing base configured to mate with a rotatable arm assembly having a indexing hub.

10. The food shield of claim 7, wherein the angular adjustment section includes an indexing base configured to mate with a rotatable arm assembly having a indexing hub for angular adjustment of the at least one shield panel.

11. The food shield of claim 6, wherein the first adjustable bracket assembly further comprises an indexing base, a rotatable arm assembly with an indexing hub, and a removable or retractable coupling element.

12. The food shield of claim 11, wherein the rotatable arm assembly via the indexing hub is configured to rotate, and wherein the one collar portion includes a series of holes, slots or recesses spaced apart in an array such that a removable or retractable coupling element engages with a respective hole, slot or recess of the indexing hub.

13. The food shield of claim 12, wherein the array comprises a circle.

14. The food shield of claim 11, wherein the rotatable arm assembly has a panel support rod defining a slot with an inner profile that is complementary to an outer profile of a male coupler of a bushing extending from the indexing hub of the rotatable arm assembly.

15. The food shield of claim 14, wherein the first panel clamp assembly is coupled to or formed at one end of the panel support rod, and the second panel clamp assembly is coupled to or formed at an opposite end of the panel support rod.

16. The food shield of claim 14, wherein the bushing is slidably positioned along the length of the panel support rod.

17. The food shield of claim 14, wherein the panel support rod is positioned below the opposite surface of the shield panel.

* * * * *